US006388578B1

(12) United States Patent
Fagan et al.

(10) Patent No.: US 6,388,578 B1
(45) Date of Patent: May 14, 2002

(54) SPEED LIMIT INDICATOR

(75) Inventors: David Fagan, 628 Clonard Rd., Crumlin; Joseph Fagan, 33 Kildare Park, Crumlin, both of Dublin (IL)

(73) Assignees: David Fagan; Joseph Fagan; John McEvoy; Gary Taaffe, all of Dublin (IL); a part interest ( * ) Notice: Subject to any disclaimer, the term of this patent is extended or adjusted under 35 U.S.C. 154(b) by 0 days.

(21) Appl. No.: 09/554,768

(22) PCT Filed: Nov. 19, 1998

(86) PCT No.: PCT/IE98/00097

§ 371 Date: Jul. 18, 2000

§ 102(e) Date: Jul. 18, 2000

(87) PCT Pub. No.: WO99/26213

PCT Pub. Date: May 27, 1999

(30) Foreign Application Priority Data

Nov. 19, 1997 (IL) ..... S970816
Jul. 2, 1998 (IL) ..... S980537

(51) Int. Cl.[7] ..... G08G 1/00
(52) U.S. Cl. ..... 340/901; 340/905; 340/906
(58) Field of Search ..... 340/901, 905, 340/906

(56) References Cited

U.S. PATENT DOCUMENTS 3,597,730 A * 8/1971 McClellan ..... 340/62
4,229,727 A * 10/1980 Gilhooley ..... 340/53
5,457,439 A 10/1995 Kuhn ..... 340/435
5,819,198 A * 10/1998 Peretz ..... 701/117
6,166,658 A * 12/2000 Testa ..... 340/905

FOREIGN PATENT DOCUMENTS

GB 2284055 A 5/1995
GB 2301924 A * 12/1996 ..... 1/8
GB 2301924 A * 12/1996

* cited by examiner

*Primary Examiner*—Jefffery Hofsass
*Assistant Examiner*—Son Tang
(74) *Attorney, Agent, or Firm*—Jacobson Holman, PLLC

(57) ABSTRACT

A speed limit indicator for, for example, a four-lane highway (1) having left lanes (3) and right lanes (4), the direction of travel indicated by the arrows. Road markings (11, 12 and 13) of different colors are used to provide an indication of the speed limit for the particular speed zone. The invention also provides a transmitter which is sited usually at the entrance to a speed zone and a receiver in a vehicle which are used to signal the speed limit to a driver.

14 Claims, 5 Drawing Sheets

SPEED LIMIT INDICATOR

BACKGROUND OF THE INVENTION

Field of the Invention

The present invention relates to a road vehicle safety device and in particular to a speed indicator for road vehicles.

Road safety is one of the major issues in society and excessive road speed is one of the major causes of accidents. In a briefing in 1995, the European Transport Safety Council stated "no ways are yet known of using design to reduce inappropriate speeds". Road safety makes an impact on the lives of almost every citizen of the EU. In 1995 the total number of people killed in road accidents in the EU member states was more than 45,000 and the number of injuries was in excess of 1.6 million people. What makes these figures even more disturbing is that they indicate a clear improvement in road safety over previous years. It is estimated that 1 in 80 European citizens will end their lives almost 40 years prematurely due to road accidents and that another 1 in 3 will need hospital treatment during their lifetime as a result of such a road accident. If one then adds to this the direct cost of road accidents and cost in pain and suffering and lost economic output, it is estimated that the total cost of road accidents exceeded 162 billion ECUs in 1995 which was about twice the total budget for that year. What is happening in the EU is indicative of what is happening in all the developed nations and must, by its very nature, indicate quite clearly that as world prosperity increases, this problem will similarly increase.

It has long been recognised that speed is playing an increasing role in such road accidents as the incidence of drunk driving is reducing and driving skills are improving. A certain amount of the excess speed is not due to deliberate or willful neglect on behalf of drivers but due to general inattention to speed limits.

It has been proposed to install speed controllers or governors in motor cars which would prevent motor cars and other vehicles exceeding preset speeds. However, this has caused enormous controversy because it is not by any means clear-cut that installing speed governors would be the ideal way of achieving this aim because many experts maintain that there are times when vehicles require the necessary speed and power to avoid dangerous situations.

A further problem that needs to be addressed, once one accepts the vehicle speed is at the core of road accident problems is that there is a need to provide prior warning of speed limits to road users. The problem is that higher speed reduces the time available to avoid collision and makes the impact of a collision more severe; there is thus a need for more adequate warning of the need to reduce speed than has heretofore been provided.

There is also a general need to indicate to road users that an imminent change in speed limit is about to occur or that, even more importantly, while the particular speed limit imposed might be 45 Km per hour, that in the particular situation, it would be advisable to reduce the speed to, for example, 30 Km per hour.

Further for other necessary good objective reasons there is considerable pressure being exerted against any attempt by the authorities to impose rigid speed controllers on vehicles that would prevent them under any circumstances exceeding certain speeds. A further problem in any case with this is that speeds which are acceptable on motorways are not acceptable in built-up areas.

Further, while many drivers are becoming more careful and are driving with considerably more care, there is still the minority who do not obey the rules of the road and who consistently over-speed. For the other road users and in particular for pedestrians, it is often difficult to judge the speed of an approaching vehicle and anything that would assist in pedestrians judging the speed of an approaching vehicle would be advantageous. Indeed, anything that would allow drivers estimate the speed of other vehicles on the road would be extremely advantageous. Additionally, anything that would allow speed of a car to be accorded and analysed, not just simply on impact when an accident occurs which would undoubtedly be useful, but also possibly for the period immediately prior to the accident, such as, for example, the preceding half hour or so. However, these latter objects, while desirable, are not nearly as important as providing a safety device that would assist drivers in avoiding excessive speed. This is the primary object to which the present invention is directed.

There is further a need for some form of warning for drivers that they are approaching areas where speed should be reduced. The present invention is also directed towards this latter aim.

SUMMARY OF THE INVENTION

According to the invention, there is provided a speed limit indicator of the type comprising visual and/or audible indication means that a particular vehicle speed should not be exceeded on the particular zone of the roadway being travelled characterised in that the indication means comprises indicia of a plurality of colours affixed to the roadway, each chosen colour being indicative of a vehicle speed appropriate for a particular speed zone. By providing lines and other markings on the road all of the one colour, the motorist will be continually reminded of the speed limit that is required and since most people wish to obey the rules of the road, this will be exceedingly advantageous.

In one embodiment of the invention, all the roadway markings are of the chosen colour within that speed zone. The advantage of this is that in, for example, built-up areas, the same colour could be used not just simply for lane divisions and the like but could also be used for parking restriction indications such as commonly now provided by single or double yellow lines. Similarly, any other traffic markings such as turning arrows, access restricting boxes, stop lines behind signs, traffic lights, etc. could all be coloured the one colour and this would be a continual indication to the road user of the speed limit.

In another embodiment of the invention, the orientation of some of the lines on the roadway are inclined to the direction of travel along the roadway to indicate desirable changes in the chosen speed for that speed zone. The advantage of this is that by changing the orientation of the lines, it is possible to indicate, for example, that while the speed limit is 45 Km per hour, in this particular area it might be advisable to reduce the speed to, for example, 30 Km per hour.

Ideally, all the associated traffic information signs incorporate the colour appropriate to that speed zone. Again, by using all the one colour on all the traffic signs for a particular speed limit zone, you are further reminding the motorist of the speed limit.

In one embodiment of the invention, there is provided a speedometer for a vehicle which includes the same colours for its speed indicia as the chosen colours.

In one embodiment of the invention, the speed limit indicator comprises a sheet for affixing to the interior of a car within sight of a driver, said sheet having indicia printed thereon identifying the speed appropriate to the chosen colours. Ideally, the motorist should have something readily available that will alert him or her to the appropriate speed limit having regard to the colour being displayed.

In another embodiment of the invention, there is provided an indicator lamp in the car, which indicator lamp transmits light of the chosen colour appropriate to the speed being travelled. Again, alerting a driver to the actual speed being travelled within a particular zone is much more advantageous than simply using a speedometer since many a motorist does not consult the speedometer very often and indeed in many instances, it would be impractical to do so.

In a further embodiment of the invention, there is provided on the exterior of the car, an indicator lamp which transmits light of the colour appropriate to the speed being travelled.

In a still further embodiment of the invention, there is provided a receiver in the car associated with an indicator lamp which transmits light of different colours and a transmitter on the roadway for transmitting a speed limit signal to the receiver to cause the lamp to display the colour appropriate to the speed zone. With this particular embodiment of the invention, it is possible for the authorities to transmit to the vehicle the required speed limit for that particular area in which the vehicle is travelling.

Ideally, means are provided associated with the receiver to cause the light to operate intermittently indicating that the speed limit is being exceeded. Again, the driver has been alerted to the fact that he or she is exceeding the limit which can be extremely advantageous.

Ideally, there is an additional audible warning device of the speed limit being exceeded. Again, anything that alerts the driver to excessive speed is useful.

BRIEF DESCRIPTION OF THE DRAWINGS

In another embodiment of the invention, light external of the car operate intermittently on the speed limit being exceeded. This has the advantage of alerting both other road users whether they be drivers or pedestrians of the fact that the approaching car is exceeding the speed limit. This can be of considerable advantage in built-up areas and will obviously be advantageous in the event of an accident taking place since the other road users will have some visual confirmation of, for example, their belief that a vehicle was exceeding the speed limit.

In another embodiment of the invention, the receiver incorporates memory means to retain the speed limit signal until another speed limit signal is received. The advantage of this is that if a car is being driven and then stops, when the car resumes travel, the speed limit information will still be retained in the vehicle so that the invention can operate satisfactorily.

In another embodiment of the invention, the memory means retains a record of the vehicle speed over a preset period of the vehicle travel time. The advantage of this is that in the event of an accident, there is a record of the speed of the vehicle, for example, prior to impact.

DETAILED DESCRIPTION OF THE INVENTION

Figure 1:
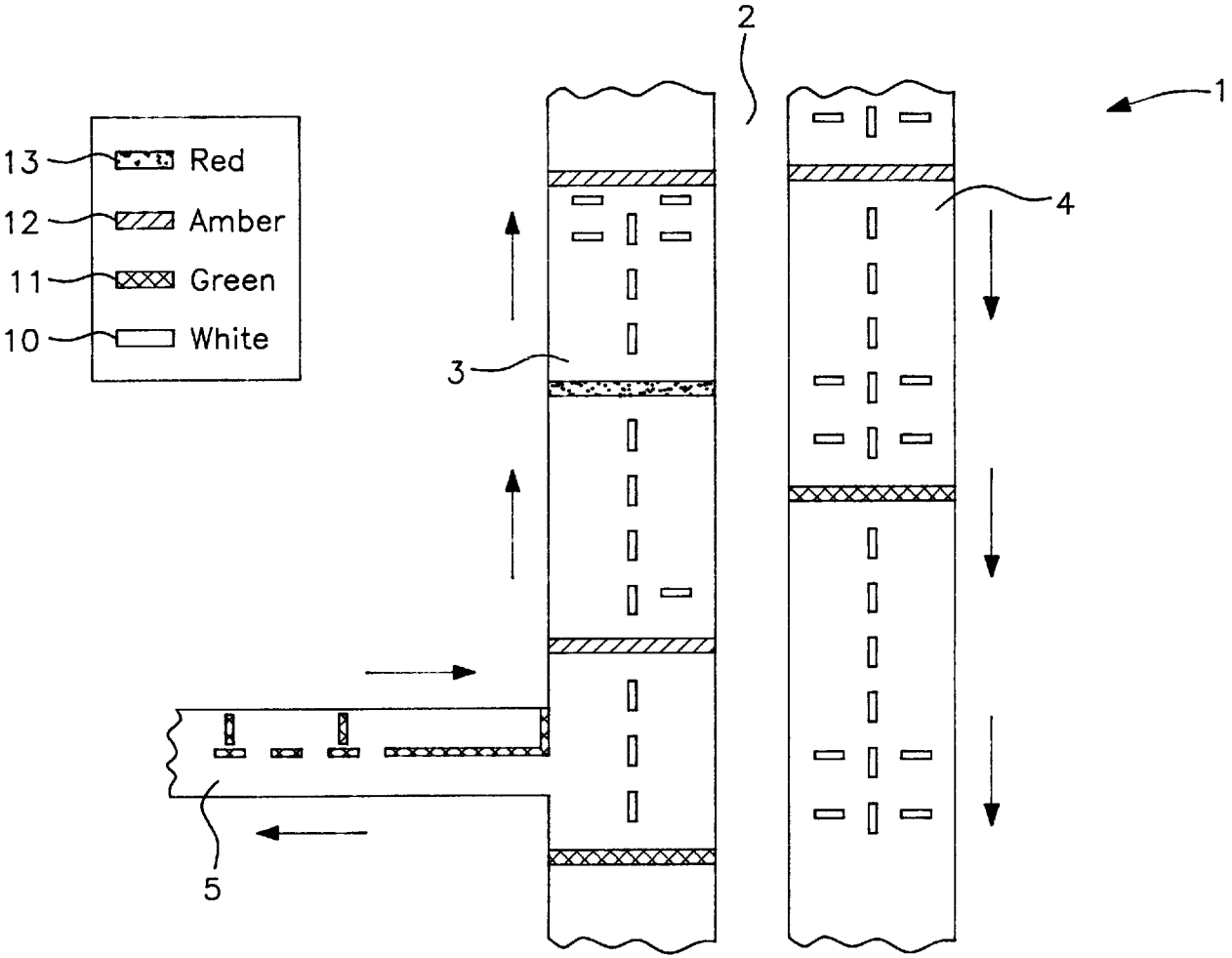
Figure 2:
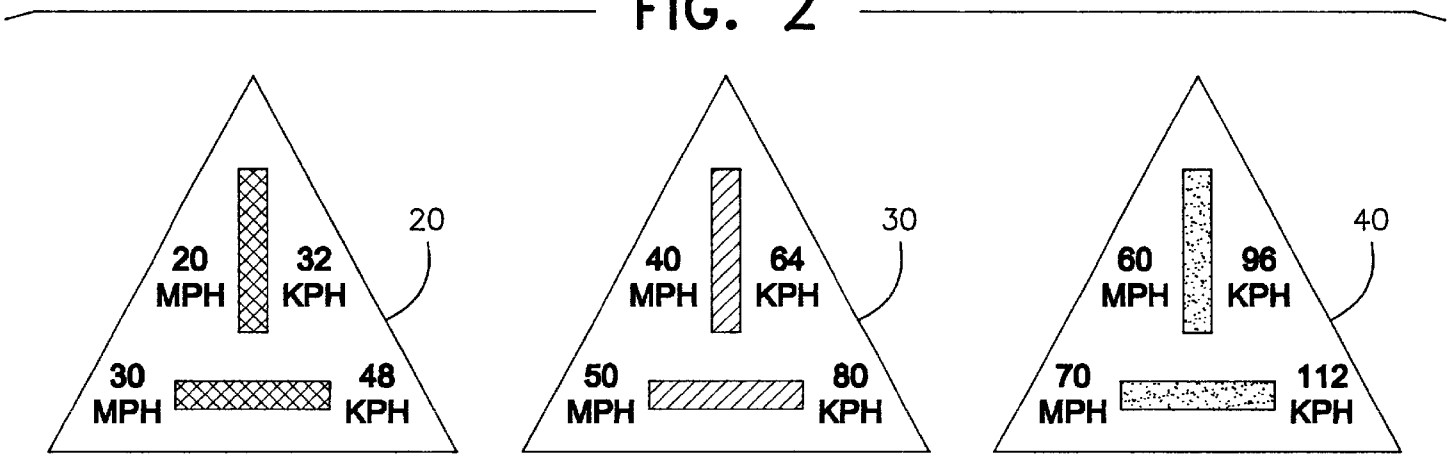
Figure 3:
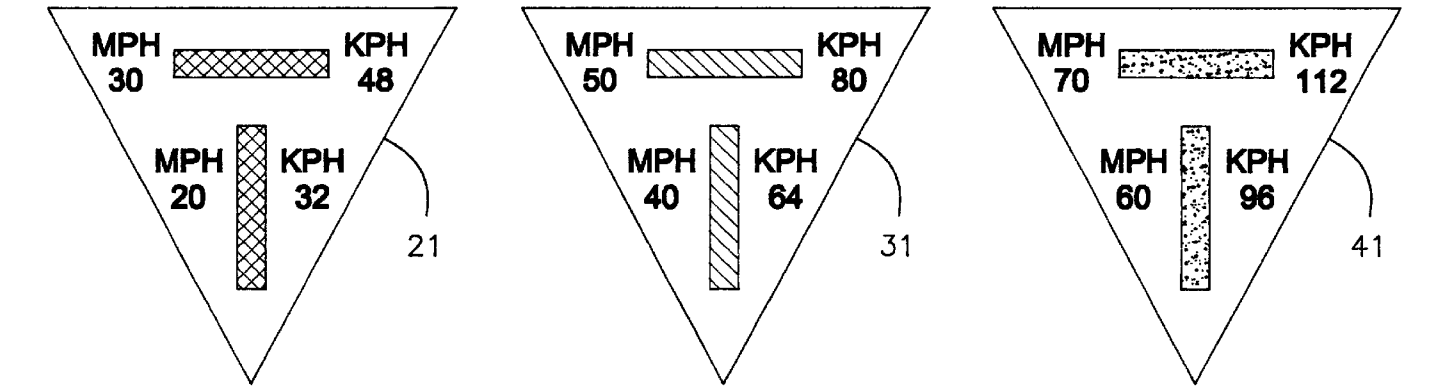
Figure 4:
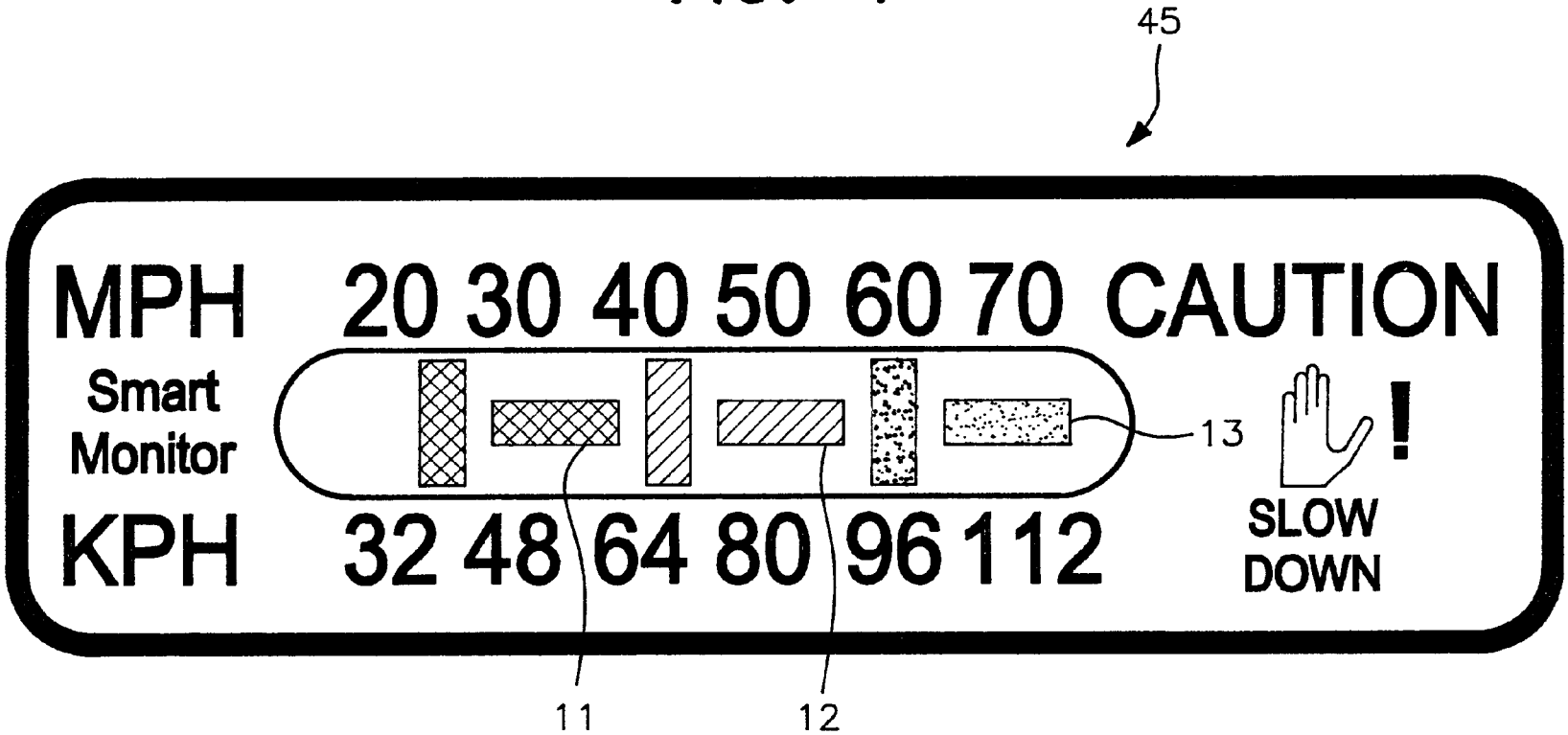
Figure 5:
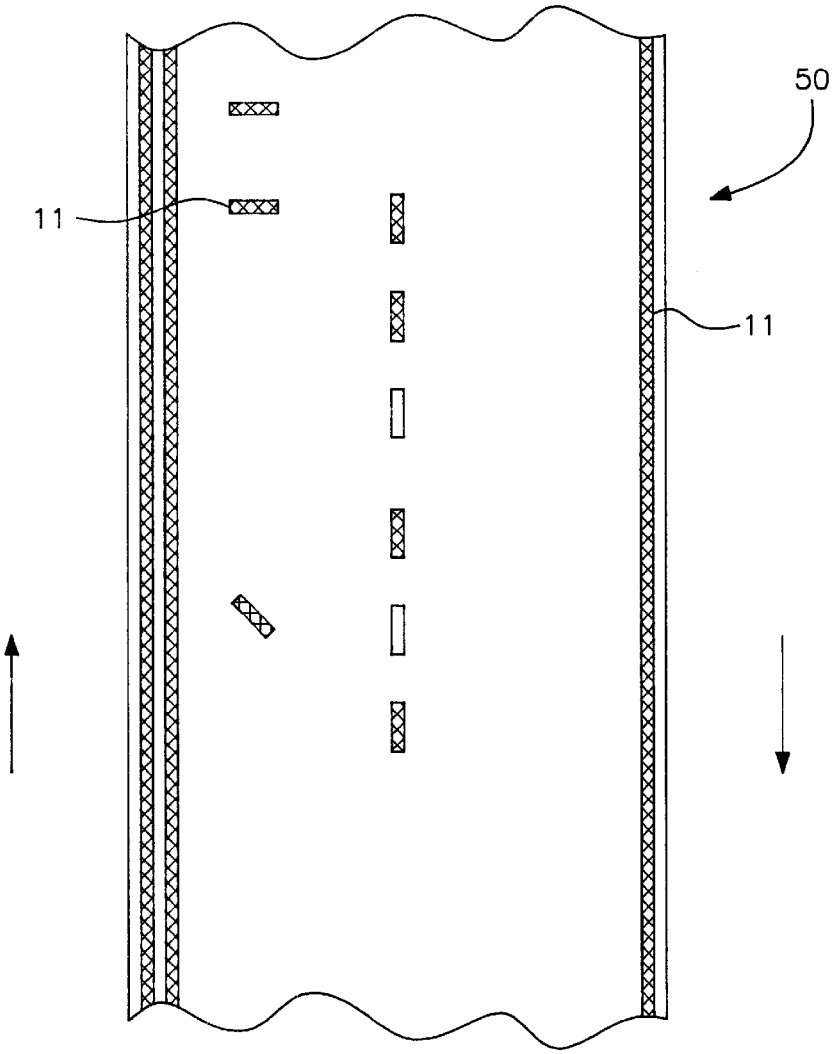
Figure 6:
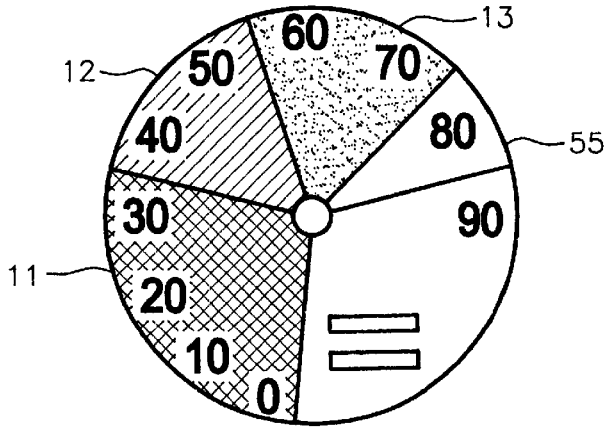
Figure 7:
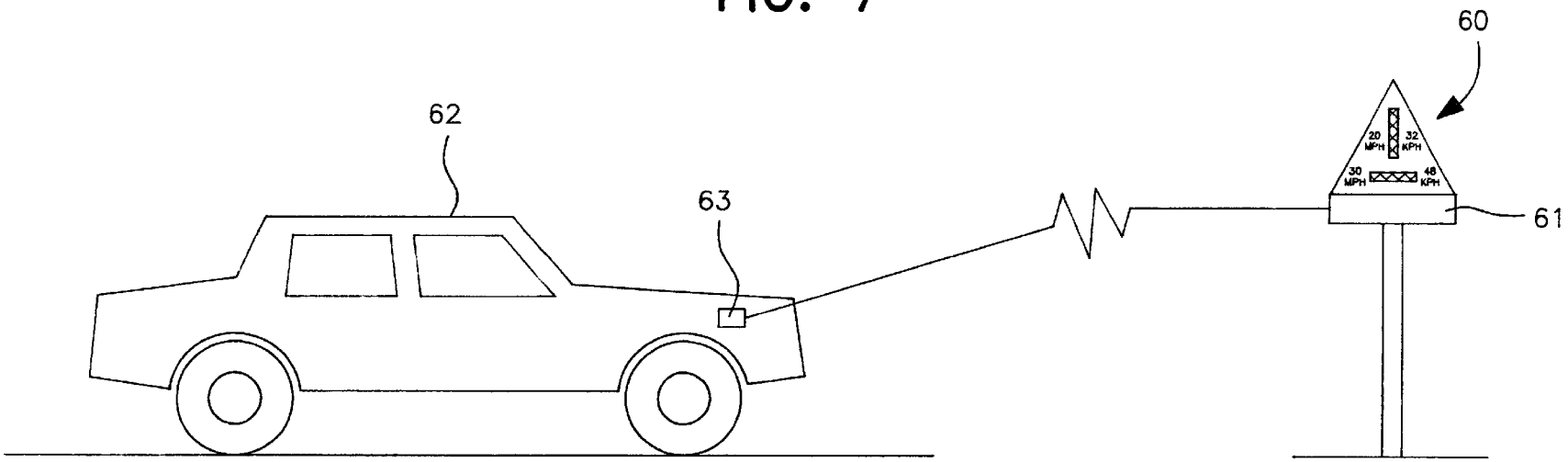

The invention will be more clearly understood from the following description of some embodiments thereof, given by way of example only, with reference to the accompanying drawings, in which:

FIG. 1 is a plan view of a roadway utilising part of the present invention,

FIG. 2 is a front view of some road signs according to the present invention, FIG. 3 is a front view of other road signs according to the invention, FIG. 4 is a front view of a sheet used in accordance with the invention, FIG. 5 is a plan view of another roadway utilising part of the invention, FIG. 6 is a front view of a speedometer incorporating part of the invention, and FIG. 7 is a diagrammatic view of a motorcar and road sign using the invention.

DESCRIPTION OF THE INVENTION

Referring to the drawings and initially to FIG. 1 thereof, there is illustrated a four lane highway indicated generally by the reference numeral 1 having a central island 2 and left lanes 3 and right lanes 4. There is illustrated a road 5 joining the left lane 3. The direction of the arrow at the sides of the lanes 3 and 4 and the road 5 identify the direction of travel.

White road markings 10, green road markings 11, amber road markings 12 and red road markings 13 are printed on the roadway.

Referring now to FIG. 2, there is illustrated three road signs indicated generally by the reference numerals 20, 30 and 40. There road sign 20 has green lettering shows that when the line is painted on the roadway in the direction of travel, it notes that the motorist should do 48 kph or 30 mile per hour speed limit and while the transverse line shows that while the speed limit is officially 30 mph, that in the particular circumstances, the speed should not exceed 20 mph.

Thus, for example a vehicle traveling along the lane 3 travels from a 30 mph into a 50 mph zone and then into a 70 mph zone. As the motorist is leaving the 70 mph zone in the left lane 3, it will be noted that there are transverse red lines 13 indicating "slow down" as the motorist is about to approach a 50 mph zone. Similarly, a motorist travelling down the motorway 4 travels from a 70 mph zone into a 50 mph zone and subsequently towards the end of the 50 mph zone, there are transverse lines showing that the motorist should now reduce speed as the motorist is about to enter a 30 mph zone. Similarly in the 30 mph zone in the right-hand lane 4, there are indications towards the end of it that there is a need to slow down. Then observing the road 5, it will be noted that when approaching the junction with the lane 3, there are transverse lines indicating the need to reduce speed.

FIG. 2 illustrates the road signs that would be used showing the speed and the code while FIG. 3 shows almost identical road signs indicated generally by the reference numeral 21, 31 and 41. Each of these correspond with the road signs 20, 30 and 40 of FIG. 3, except that they are now directed in the opposite direction, the purpose of which is to indicate to the motorist that the motorist is approaching a place where he or she should slow down.

Referring now to FIG. 4, there is illustrated a card or sheet 45 which could be affixed to a vehicle's dashboard or the like or adjacent the speedometer to illustrate to the motorist the code and the need to slow down. FIG. 4 illustrates a sheet that could be affixed to the dashboard of a motorcar to indicate clearly to the motorist the purpose of the various road signs. The same reference numerals and batching is used to identify the same colours.

Referring now to FIG. 5, there is illustrated an alternative way of marking a roadway 50 in which all the markings are in green to indicate that the roadway is to be travelled at a speed not greater than 30 mph and that further, on the left-hand side, there are two continuous green lines indicating that parking is forbidden at all times, while on the right-hand side for the traffic going in the opposite direction, there is a single line indicating that stopping is prohibited in certain circumstances. It will be seen that there are lines initially slanted on inclined towards the direction of travel and then finally the lines are painted directly across the line of travel to indicate the need to slow down even though the area is a 30 mph speed limit area and probably about to approach a junction. It will be appreciated that the frequency of the line can be further used to indicate the need to slow down rapidly.

While in the embodiments above, the colours white, green, amber and red have been used, it will be appreciated that in many instances. It might be decided to use the colours and in combination with the colour white which is the conventional road marking colour. It might be more advantageous to use the colour white for one particular speed limit, for example, all minimum urban speed limits, to use the colour amber for intermediate speeds, and red for the top speeds. However, the choice of colour and the manner in which the marking is made is are largely irrelevant.

Referring to FIG. 6, there is illustrated a speedometer 55 in which the various quadrants of the speedometer are coloured to coincide with the speed limits. FIG. 7 illustrates an alternative road sign indicated generally by the reference numeral 60 having a radio transmitter 61 and also illustrates a motor car 62 having a radio receiver 63. This would, generally speaking, be a short range radio receiver and transmitter. The receiver 63 and transmitter 61 are infrared devices.

Ideally, the receiver 63 has a microprocessor incorporated therein having a memory and recording means. In use, the receiver 63 will store a signal from the transmitter 61 which signal will indicate the speed limit. Further, the receiver 63 is connected operatively to the speedometer of the car whereby it records the speed travelled by the car. The receiver 63 can record the speed travelled by the motorcar over periods of time continually updating the records so that there is always stored in the receiver 63 a record of, for example, the previous half hours driving. Further, the receiver 63 can be operatively connected to an indicating lamp or indeed to an audible warning device mounted in the motorcar whereby, on the receiver 63, receiving a signal to indicate a particular speed limited from the transmitter 61 on the road sign 60, the receiver 63 will then read the speed of the vehicle and operate, if necessary, the indicating lamp and/or the audible warning device. Ideally, the indicating lamp in this situation will be programmed to operate intermittently, thus giving a flashing light within the vehicle warning the driver that he or she is exceeding the speed limit.

In an alternative embodiment of the invention, where there is no transmitter and receiver, there may be provided both a lamp in the motorcar which lamp will be visible to the driver, the lamp being such as to cause light to be delivered in various colours corresponding to the speed at which the car is travelling. In other words, if the speed chosen does not lead to a colour being displayed the same as that on the road markings, the driver is immediately alerted to the fact that he or she is outside the speed limit. It can be so arranged that the lamp does not come on when the car is driving below the preset speed limit.

It will be appreciated that a speedometer could be provided, the visual appearance of which would be identical to that of the sheet illustrated in FIG. 4.

It is also envisaged that where there is a receiver and transmitter fitted, that it would be possible for the receiver to operate external lights of a car to cause them to flash on and off such as the normal hazard warning lights thus indicating to other road users that the car was driving at above the speed limit. It is further envisaged that exterior lights could be fitted to a motorcar which would change colour in the appropriate manner depending on the speed at which the vehicle was travelling.

It will be appreciated that a major advantage of the receiver having incorporated a memory is that in the event of there being a crash, it will be possible to download the information relating to the vehicle speed, not just only at impact but immediately prior thereto. Further, by having external warning lights such as, for example, a warning light which will always show the range of the vehicle speed, it will be possible for pedestrians and other road users to gauge the speed of an approaching vehicle and thus take the appropriate action. This will also be advantageous to those charged with enforcing speed limits in that cars travelling above the speed limit will immediately be shown to be doing so.

In this embodiment, the terms "comprise, comprises, comprised and comprising" are used interchangeably with "include, includes, included and including" and additionally they are to be afforded the widest possible interpretation.

The invention is not limited to the embodiments hereinbefore described but may be varied in both construction and detail within the scope of the claims.

What is claimed is:

1. A speed limit indicator for use in conjunction with a vehicle travelling on a roadway comprising visual indication member for indicating a maximum particular vehicle speed on a particular speed zone of the roadway being travelled, the visual indication member includes indicia of a plurality of colours affixed to the roadway, each chosen colour being indicative of a vehicle speed appropriate for a particular speed zone, and an orientation of some of the indicia on the roadway being inclined to a direction of travel along the roadway for indicating desirable changes in the chosen speed for that particular speed zone.

2. The speed limit indicator as claimed in claim 1, in which all the roadway markings are of the chosen colour within that speed zone.

3. The speed limit indicator as claimed in claim 1, in which all associated traffic information signs incorporate the colour appropriate to that speed zone.

4. The speed limit indicator as claimed in claim 1 in which there is provided a speedometer for a vehicle which includes the same colours for its speed indicia as the chosen colours.

5. The speed limit indicator as claimed in claim 1 comprising a sheet for affixing to the interior of a car within sight of a driver, said sheet having indicia printed thereon identifying the speed appropriate to the chosen colours.

6. The speed limit indicator as claimed in claim 1, in which there is provided an indicator lamp in the car, which indicator lamp transmits light of the chosen colour appropriate to the speed being travelled.

7. The speed limit indicator as claimed in claim 1, in which there is provided on the exterior of the car an indicator lamp which transmits light of the colour appropriate to the speed being travelled.

8. The speed limit indicator as claimed in claim 1, in which there is provided a receiver in the car associated with an indicator lamp which transmits light of different colours and a transmitter on the roadway for transmitting a speed limit signal to the receiver to cause the lamp to display the colour appropriate to the speed zone.

9. The speed limit indicator as claimed in claim 8, in which there are members associated with the receiver to cause the light to operate intermittently for indicating that the speed limit is being exceeded.

10. The speed limit indicator as claimed in claim 9, in which the colour changes on the speed limit being exceeded.

11. The speed limit indicator as claimed in claim 10, in which lights external of the car operate intermittently on the speed limit being exceeded.

12. The speed limit indicator as claimed in claim 9, in which there is an additional audible warning device of the speed limit being exceeded.

13. The speed limit indicator as claimed in claim 8, in which the receiver incorporates memory to retain the speed limit signal until another speed limit signal is received.

14. The speed limit indicator as claimed in claim 13, in which the memory retains a record of the vehicle speed over a preset period of the vehicle travel time.

* * * * *